US005831421A

United States Patent [19]

Taira et al.

[11] Patent Number: 5,831,421

[45] Date of Patent: Nov. 3, 1998

[54] SEMICONDUCTOR DEVICE WITH SUPPLY VOLTAGE-LOWERING CIRCUIT

[75] Inventors: Takashi Taira; Kazuyoshi Muraoka, both of Yokohama, Japan

[73] Assignee: Kabushiki Kaisha Toshiba, Kawasaki, Japan

[21] Appl. No.: 837,461

[22] Filed: Apr. 18, 1997

[30] Foreign Application Priority Data

Apr. 19, 1996 [JP] Japan ..... 8-098854

[51] Int. Cl.[6] ..... G05F 3/16

[52] U.S. Cl. ..... 323/314

[58] Field of Search ..... 323/312, 313, 323/314, 281; 327/530, 536, 538, 541

[56] References Cited

U.S. PATENT DOCUMENTS

| | | | |
|---|---|---|---|
| 4,788,455 | 11/1988 | Mori et al. | 307/296.6 |
| 4,868,483 | 9/1989 | Tsujimoto | 323/313 |
| 4,994,688 | 2/1991 | Horiguchi et al. | 307/296.8 |
| 5,086,238 | 2/1992 | Watanabe et al. | 307/296.6 |
| 5,146,152 | 9/1992 | Jin et al. | 323/280 |
| 5,376,839 | 12/1994 | Horiguchi et al. | 327/541 |
| 5,442,277 | 8/1995 | Mori et al. | 323/312 |
| 5,444,362 | 8/1995 | Chung et al. | 323/313 |

FOREIGN PATENT DOCUMENTS 5-21738 1/1993 Japan .

*Primary Examiner*—Adolf Berhane

*Attorney, Agent, or Firm*—Finnegan, Henderson, Farabow, Garrett & Dunner, L.L.P.

[57] ABSTRACT

A semiconductor device includes an internal circuit and first and second supply voltage-lowering circuits in its semiconductor chip. The first supply voltage-lowering circuit steps down an external power supply potential of the semiconductor chip in response to a control signal, generates a first internal power supply potential, and supplies it to the internal circuit. The second supply voltage-lowering circuit steps down the external power supply potential of the semiconductor chip in response to the control signal, generates a second internal power supply potential of substantially the same level as that of the first internal power supply potential, and supplies it to the internal circuit. The first and second internal power supply potentials output from the first and second supply voltage-lowering circuits vary out of phase with each other to cancel out variations in first and second internal power supply potentials.

26 Claims, 12 Drawing Sheets

SEMICONDUCTOR DEVICE WITH SUPPLY VOLTAGE-LOWERING CIRCUIT

BACKGROUND OF THE INVENTION

The present invention relates to a semiconductor device having a supply voltage-lowering circuit which steps down an external power supply potential to generate an internal power supply potential and supply it to the internal circuit of a semiconductor chip.

In recent years, as the elements of semiconductor devices continue to shrink, e.g., the gate oxide film of a MOS transistor is becoming thinner, and the breakdown voltage is becoming lower. For this reason, a supply voltage-lowering circuit is incorporated in a semiconductor chip to step down an external power supply potential within the chip and supply the obtained potential to the internal circuit, thereby decreasing the electric field strength applied to the gate oxide film. Such a technique is disclosed in, e.g., Jpn. Pat. Appln. KOKAI Publication No. 5-21738.

However, the output characteristics of this supply voltage-lowering circuit are unstable due to various noise factors, and this leads to malfunctions of the internal circuit.

FIG. 1 is a block diagram showing the schematic arrangement of a semiconductor memory device as an example of a semiconductor device having a supply voltage-lowering circuit. FIG. 1 shows an extracted circuit portion related to the supply voltage-lowering circuit. A semiconductor chip 11 receives an external power supply potential Vext, a ground potential GND, an input signal Vin, a chip control signal /RAS, and the like. This chip 11 includes a memory portion 12, an internal circuit 13, a supply voltage-lowering circuit 14, and the like. The supply voltage-lowering circuit 14 steps down the external power supply potential Vext applied to the chip 11 to generate an internal power supply potential Vint and supply it to a power supply line 15-1. The ground potential GND is externally applied to a power supply line 15-2 and used as an internal ground potential Vss. Both the power supply lines 15-1 and 15-2 are connected to the memory portion 12 and the internal circuit 13 to apply an operation voltage. A capacitor 16 equivalently represents the capacitance between the power supply lines 15-1 and 15-2.

FIG. 2 shows an example of the configuration of the supply voltage-lowering circuit 14 in the circuit shown in FIG. 1. This circuit 14 is constituted by a current-mirror differential amplifier M including P-channel MOS transistors T1 and T2 and N-channel MOS transistors T3 to T5, a P-channel MOS transistor T7 which controls the operation of the differential amplifier M, N-channel MOS transistors T6 and T8, a driving P-channel MOS transistor T0 for stepping down the external power supply potential Vext to the internal power supply potential Vint and supplying it to the memory portion 12 and the internal circuit 13, resistors R1 and R2 which generate a monitor potential Vm to monitor the level of the internal power supply potential Vint, and the like.

The sources of the MOS transistors T1 and T2 are commonly connected, to the common source connecting point of which the external power supply potential Vext is applied. The drains of the MOS transistors T1 and T2 are respectively connected to those of the MOS transistors T3 and T4, and the sources of the MOS transistors T3 and T4 are commonly connected. The gates of the MOS transistors T1 and T2 are commonly connected, and this common gate connecting point is connected to the common drain connecting point between the MOS transistors T2 and T4. A reference potential Vref generated by a reference potential generation circuit (not shown) is applied to the gate of the MOS transistor T3, and the monitor potential Vm is applied to the gate of the MOS transistor T4. The drain of the MOS transistor T5 is connected to the source connecting point between the MOS transistors T3 and T4, its gate is connected to the gate connecting point between the MOS transistors T1 and T2, and its source is connected to the drain of the MOS transistor T6. The internal ground potential Vss is applied to the source of the MOS transistor T6, and an internal RAS* signal (signal having a phase opposite to that of the chip control signal /RAS) is supplied to the gate.

The source of the MOS transistor TO receives the external power supply potential Vext, and its gate is connected to an output node N1 (drain connecting point between the MOS transistors T1 and T3) of the differential amplifier M. The channel width W of the MOS transistor T0 has an optimum value which is determined by the sum of power consumptions of the memory portion 12 and the internal circuit 13. The source of the MOS transistor T7 is connected to the drain of the MOS transistor T0, and its gate receives the chip control signal /RAS. The internal ground potential Vss is applied to the source of the MOS transistor T8, and the external power supply potential Vext is applied to its gate. The resistors R1 and R2 are series-connected between the drains of the MOS transistors T7 and T8. The gate of the MOS transistor T4 is connected to the connecting point between the resistors R1 and R2 to apply the monitor potential Vm. The internal power supply potential Vint is output from the connecting point (output node N2) between the drain of the MOS transistor T0 and the source of the MOS transistor T7.

In the above arrangement, as shown in a timing chart of FIG. 3, when the chip control signal /RAS is at "H" level (internal RAS* signal is at "L" level), the MOS transistors T6 and T7 are OFF, and the differential amplifier M is inactive. At this time, the transistor T0 is OFF because the output node N1 of the differential amplifier M, i.e., the gate potential Vg of the MOS transistor T0 is at "H" level. The monitor potential Vm is equal to the internal ground potential Vss because the connecting point between the resistors R1 and R2 is grounded through the resistor R2 and the drain-source path of the MOS transistor T8.

When the chip control signal /RAS changes from "H" level to "L" level (internal RAS* signal changes from "L" level to "H" level), the MOS transistor T6 is turned on to activate the differential amplifier M, and the MOS transistor T7 is also turned on. At this time, Vm<Vref because the monitor potential Vm becomes equal to the internal ground potential Vss. The output node N1 (potential Vg) of the differential amplifier M is inverted to "L" level to turn on the MOS transistor T0. Accordingly, the output node N2 of the supply voltage-lowering circuit 14 is charged by the external power supply potential Vext to raise the internal power supply potential Vint. When the potential Vint is charged from the standby potential Vss to Vint r2/(r1+r2)=Vref (r1 and r2: resistance values of the resistors R1 and R2), Vm>Vref holds. The output node N1 of the differential amplifier M changes to "H" level to turn off the MOS transistor T0, which interrupts the supply of electric charges to the output node N2 of the supply voltage-lowering circuit 14. When the potential Vm falls and Vm<Vref holds, the MOS transistor T0 is turned on again to repeatedly perform the same operation.

As described above, when the chip control signal /RAS is at "HI" level (internal RAS* signal is at "L" level), the supply voltage-lowering circuit 14 is discharged to set the monitor potential Vm to the ground potential Vss regardless of the internal power supply potential Vint. When the signal /RAS changes from "H" level to "L" level, the internal power supply potential Vint must be forced to rise until Vm<Vref, in order to operate the memory portion 12 and the internal circuit 13. In this case, when the signal /RAS changes to "L" level, a large current Iint flows from the supply voltage-lowering circuit 14 to the memory portion 12 and the internal circuit 13 to increase the power consumption. As a result, the internal power supply potential Vint becomes higher than the set potential.

A CMOS inverter 17 constituted by a P-channel MOS transistor Tp and an N-channel MOS transistor Tn, like the one shown in FIG. 4, is normally arranged on the first stage of the internal circuit 13 shown in FIG. 1. The source of the MOS transistor Tp is connected to the power supply line 15-1, its drain is connected to that of the MOS transistor Tn, and its gate receives an input signal Vin. The source of the MOS transistor Tn is connected to the power supply line 15-2, and its gate receives the input signal Vin. A signal Vout output from the drain connecting point between the MOS transistors Tp and Tn is supplied to the circuit on the next stage.

FIG. 5 shows the characteristics of the CMOS inverter 17. Reference symbol Vt denotes a threshold voltage of this circuit. As shown in FIG. 5, the threshold voltage Vt is dependent on the power supply voltage, and changes in phase with the internal power supply potential Vint. As shown in FIG. 1, the internal power supply potential Vint and the internal ground potential Vss output from the supply voltage-lowering circuit 14 are equivalent to those coupled through the capacitor 16 (capacitance). Therefore, in response to variations in potential Vint, the internal ground potential Vss also varies in phase. However, the external ground potential GND is not always in phase with the internal power supply potential Vint and the internal ground potential Vss. For this reason, variations in threshold voltage Vt upon variations in internal power supply potential Vint may change the determination criterion of "H"/"L" level of the input signal Vin with reference to the external ground potential GND. To assure the operations of the memory portion 12 and the internal circuit 13, a stable internal power supply potential Vint must be supplied.

However, in the supply voltage-lowering circuit 14 having an arrangement like the one shown in FIG. 2, immediately after the chip control signal /RAS changes to "L" level, or when the power consumption in the chip 11 increases to decrease the internal power supply potential Vint, the driving MOS transistor T0 is turned on to supply electric charges from the terminal of the external power supply potential Vext to the output node N2, resulting in an increase in internal power supply potential Vint. The variation in internal power supply potential Vint is determined by the supply amount and consumption amount of electric charges. The charge consumption amount in turn is determined by the power consumption in the chip. As the power consumption in the chip increases with an increase in chip area or the like, the charge consumption amount inevitably increases to require a larger charge supply amount. For this reason, the internal power supply potential Vint greatly varies along with the increase in chip area.

To solve this problem, it is conceivable to decrease the channel width W of the driving MOS transistor T0 which supplies the internal power supply potential Vint. However, the channel width W of the MOS transistor T0 must ensure a driving ability which can cope with an increase in power consumption of the chip when, e.g., the signal /RAS changes to PLO level. The channel width W cannot be set smaller only to suppress variations in internal power supply potential Vint. Accordingly, variations in internal power supply potential Vint become larger in proportion to the increase in power consumption in the chip, and a stable internal power supply potential Vint becomes hard to supply.

As described above, in the semiconductor device having the conventional supply voltage-lowering circuit, the internal power supply potential output from the supply voltage-lowering circuit varies immediately after the operation starts or when the power consumption in the chip increases abruptly, resulting in a malfunction of the internal circuit.

BRIEF SUMMARY OF THE INVENTION

It is therefore the first object of the present invention to provide a semiconductor device having a supply voltage-lowering circuit which can suppress variations in internal power supply potential and generate a stable internal power supply potential.

It is the second object of the present invention to provide a semiconductor memory device having a supply voltage-lowering circuit which can suppress variations in internal power supply potential and generate a stable internal power supply potential.

To achieve the first object of the present invention described above, there is provided a semiconductor device comprising a semiconductor chip, an internal circuit arranged in the semiconductor chip, a first supply voltage-lowering circuit arranged in the semiconductor chip to step down an external power supply potential of the semiconductor chip in response to a control signal, generate a first internal power supply potential, and supply the first internal power supply potential to the internal circuit, and a second supply voltage-lowering circuit arranged in the semiconductor chip to step down the external power supply potential of the semiconductor chip in response to the control signal, generate a second internal power supply potential of substantially the same level as that of the first internal power supply potential, and supply the second internal power supply potential to the internal circuit, wherein the first and second internal power supply potentials output from the first and second supply voltage-lowering circuits change out of phase with each other to cancel out variations in first and second internal power supply potentials.

With this arrangement, variations in first internal power supply potential are canceled out by those in second internal power supply potential by making the potentials of the first and second supply voltage-lowering circuits change out of phase with each other. Therefore, variations in internal power supply potential can be suppressed, and a stable internal power supply potential can be generated.

To achieve the first object of the present invention described above, there is provided a semiconductor device comprising a semiconductor chip, an internal circuit arranged in the semiconductor chip, a first supply voltage-lowering circuit arranged in the semiconductor chip to step down an external power supply potential of the semiconductor chip in response to a control signal, generate a first internal power supply potential, and supply the first internal power supply potential to the internal circuit, and a second supply voltage-lowering circuit arranged in the semiconductor chip to step down the external power supply potential of the semiconductor chip in response to the control signal, generate a second internal power supply potential of substantially the same level as that of the first internal power supply potential, and supply the second internal power supply potential to the internal circuit, wherein the first and second supply voltage-lowering circuits have different operation threshold voltages, and the first and second internal power supply potentials are out of phase to cancel out variations in first and second internal power supply potentials.

With this arrangement, variations in first internal power supply potential are canceled out by those in second internal power supply potential by setting different operation threshold voltages for the first and second supply voltage-lowering circuits. Therefore, variations in internal power supply potential can be suppressed, and a stable internal power supply potential can be generated.

Further, to achieve the first object of the present invention, there is provided a semiconductor device comprising a semiconductor chip, an internal circuit arranged in the semiconductor chip, a first supply voltage-lowering circuit arranged in the semiconductor chip to step down an external power supply potential of the semiconductor chip in response to a control signal, generate a first internal power supply potential, and supply the first internal power supply potential to the internal circuit, and a second supply voltage-lowering circuit arranged in the semiconductor chip to step down the external power supply potential of the semiconductor chip in response to the control signal, generate a second internal power supply potential of substantially the same as the first internal power supply potential, and supply the second internal power supply potential to the internal circuit, wherein the first and second supply voltage-lowering circuits have different response speeds to generate a phases difference between the first and second internal power supply potentials to cancel out variations in first and second internal power supply potentials.

With this arrangement, variations in first internal power supply potential are canceled out by those in second internal power supply potential by setting different response speeds for the first and second supply voltage-lowering circuits. Therefore, variations in internal power supply potential can be suppressed, and a stable internal power supply potential can be generated.

To achieve the second object of the present invention, there is provided a semiconductor memory device comprising a semiconductor chip, a plurality of memory cell arrays arranged in the semiconductor chip and divided into at least two subarrays in vertical and horizontal directions, pads arranged along at least two opposite sides of the semiconductor chip around the plurality of memory cell arrays, a first supply voltage-lowering circuit arranged in the semiconductor chip to step down an external power supply potential of the semiconductor chip in response to a control signal, generate a first internal power supply potential, and supply the first internal power supply potential to the memory cell arrays, and a second supply voltage-lowering circuit arranged in the semiconductor chip to step down the external power supply potential of the semiconductor chip in response to the control signal, generate a second internal power supply potential of substantially the same level as that of the first internal power supply potential, and supply the second internal power supply potential to the memory cell arrays, the second supply voltage-lowering circuit being cancel out variation in first internal power supply potential by variation in second internal power supply potential, wherein the first and second supply voltage-lowering circuits are respectively arranged near center pads on the two opposite sides of the semiconductor chip to be adjacent to each other, pads near the first and second supply voltage-lowering circuits receive the external power supply potential and an external ground potential.

With this arrangement, variations in first internal power supply potential are canceled out by those in second internal power supply potential of the second supply voltage-lowering circuit. Therefore, variations in internal power supply potential can be suppressed, and a stable internal power supply potential can be generated. In addition, the first and second supply voltage-lowering circuits are arranged near the central portion of the semiconductor chip to be adjacent to the pad for inputting the external power supply potential and the pad for inputting the external ground potential. Variations in internal power supply potential can be minimized, a uniform potential can be supplied in the chip, and malfunctions caused by variations in internal power supply potential can be suppressed.

To achieve the second object of the present invention, there is provided a semiconductor memory device comprising a semiconductor chip, a plurality of memory cell arrays arranged in the semiconductor chip and divided into at least two subarrays in vertical and horizontal directions, pads arranged between central memory cell arrays of the plurality of memory cell arrays, a first supply voltage-lowering circuit arranged in the semiconductor chip to step down an external power supply potential of the semiconductor chip in response to a control signal, generate a first internal power supply potential, and supply the first internal power supply potential to the memory cell arrays, and a second supply voltage-lowering circuit arranged in the semiconductor chip to step down the external power supply potential of the semiconductor chip in response to the control signal, generate a second internal power supply potential of substantially the same level as that of the first internal power supply potential, and supply the second internal power supply potential to the memory cell arrays, the second supply voltage-lowering circuit being cancel out variation in first internal power supply potential by variation in second internal power supply potential, wherein the first and second supply voltage-lowering circuits are respectively arranged near center pads to be adjacent to each other, pads near the first and second supply voltage-lowering circuits receive the external power supply potential and an external ground potential.

With this arrangement, variations in first internal power supply potential are canceled out by those in second internal power supply potential of the second supply voltage-lowering circuit. Therefore, variations in internal power supply potential can be suppressed, and a stable internal power supply potential can be generated. In addition, the first and second supply voltage-lowering circuits are arranged near the central portion of the semiconductor chip with a short distance therebetween together with the pads. Also in the semiconductor memory device having center pads, a uniform potential can be supplied in the chip, and malfunctions can be suppressed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
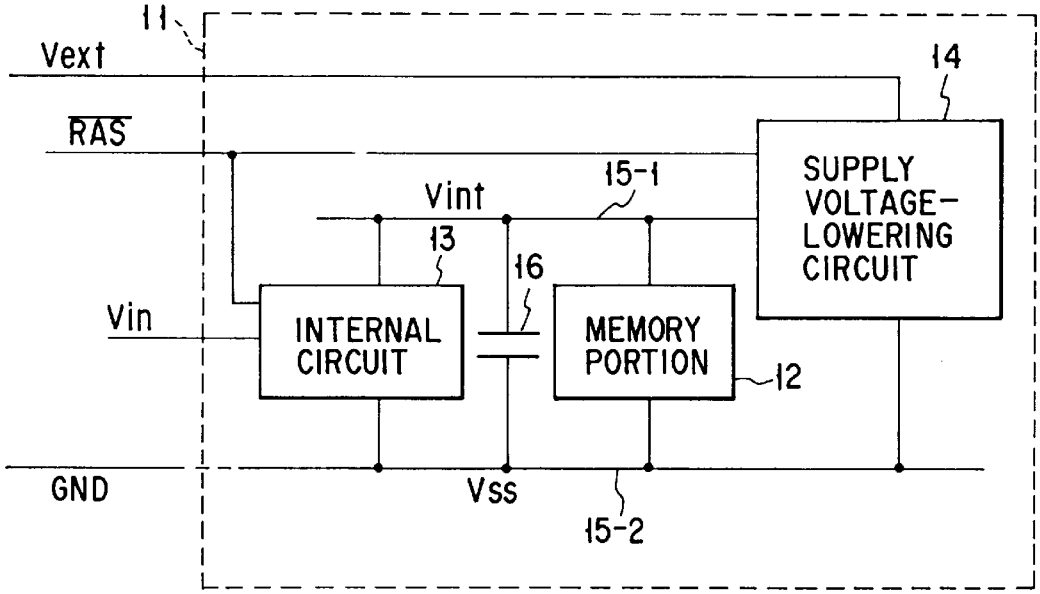
FIG. 1 PRIOR ART
FIG. 1 is a block diagram showing the schematic arrangement of an extracted circuit portion related to a supply voltage-lowering circuit of a semiconductor memory device to explain a conventional semiconductor device having the supply voltage-lowering circuit.
Figure 2:
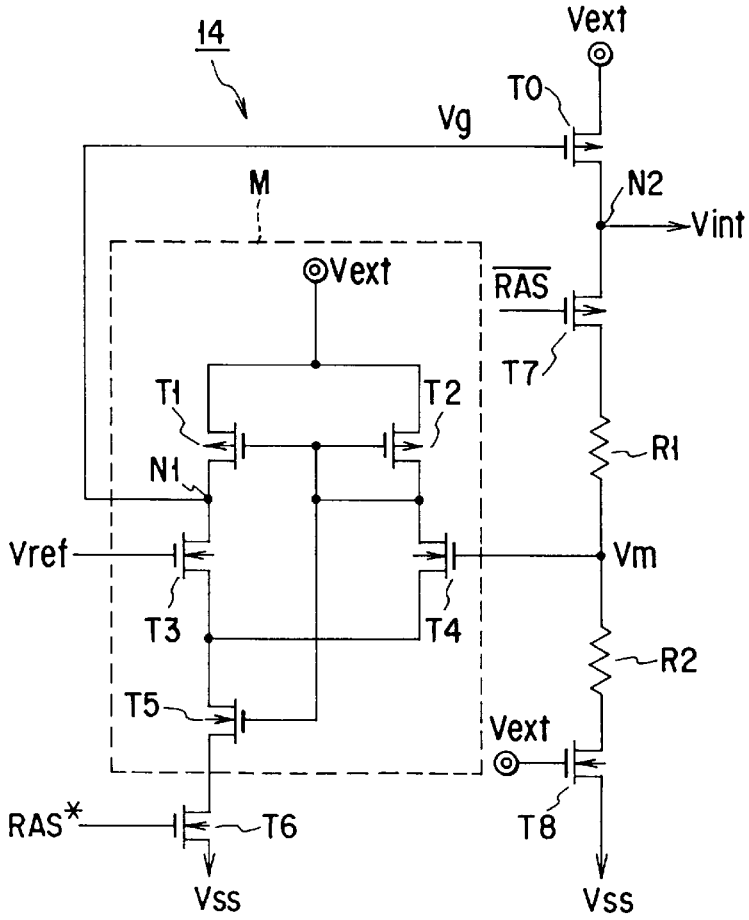
FIG. 2 PRIOR ART
FIG. 2 is a circuit diagram showing an example of the configuration of the supply voltage-lowering circuit in the circuit shown in FIG. 1.
Figure 3:
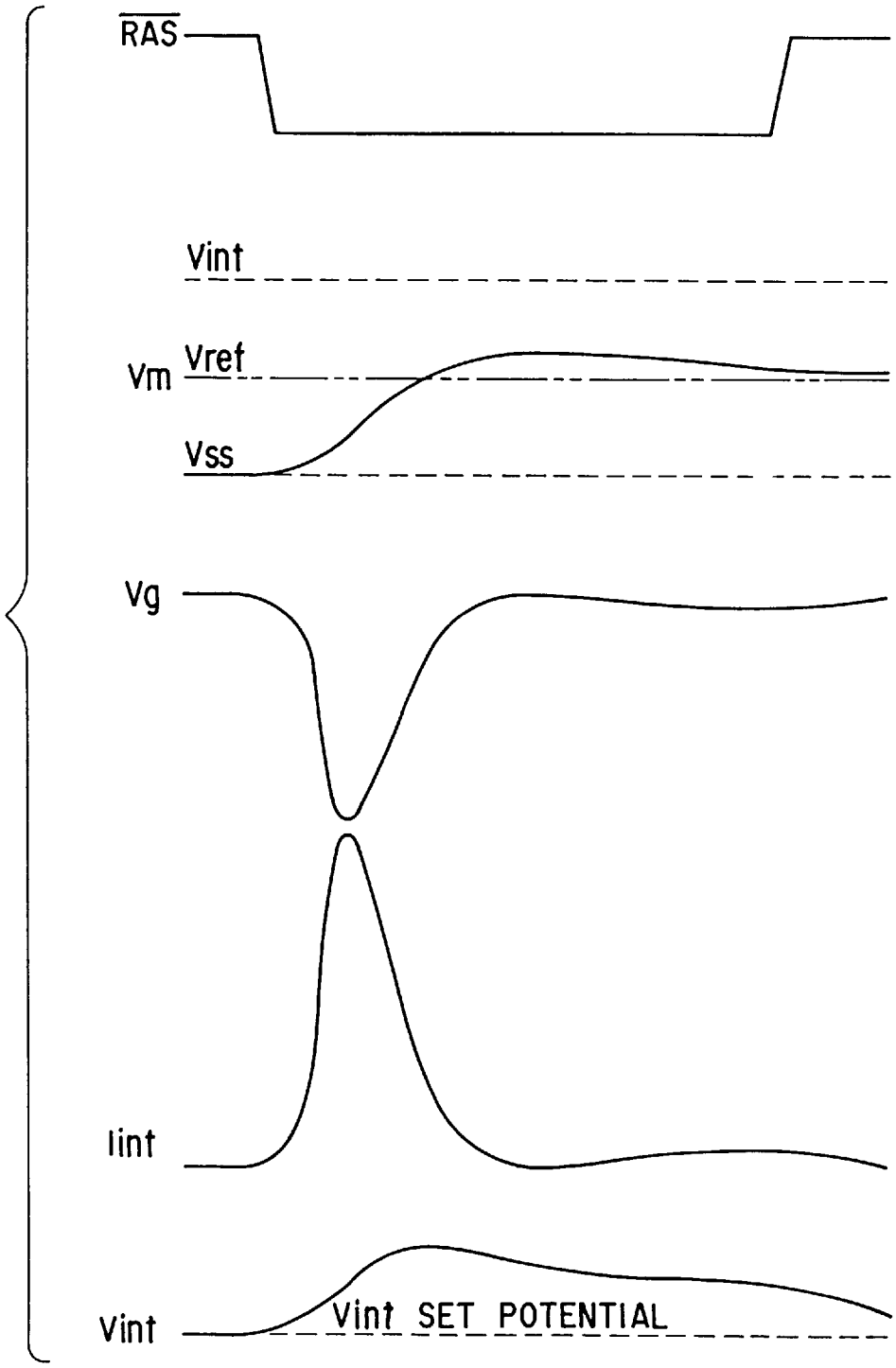
F I G. 3 PRIOR ART
FIG. 3 is a timing chart for explaining the operation of the circuit shown in FIG. 2.
Figure 4:
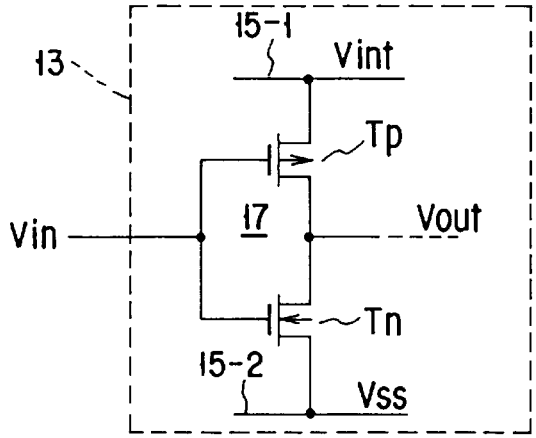
FIG. 4 PRIOR ART
FIG. 4 is a circuit diagram showing an example of the configuration of the first stage of the internal circuit in the circuit shown in FIG. 1.
Figure 5:
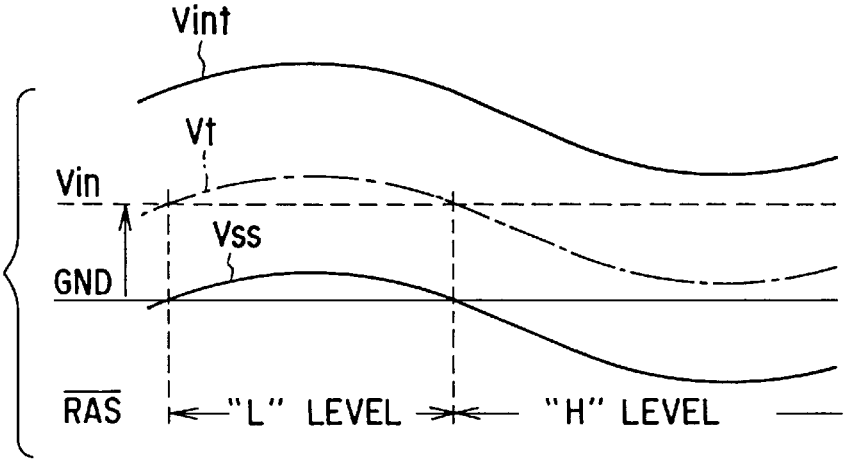
FIG. 5 PRIOR ART
FIG. 5 is a waveform chart for explaining the characteristics of a CMOS inverter shown in FIG. 4.
Figure 6:
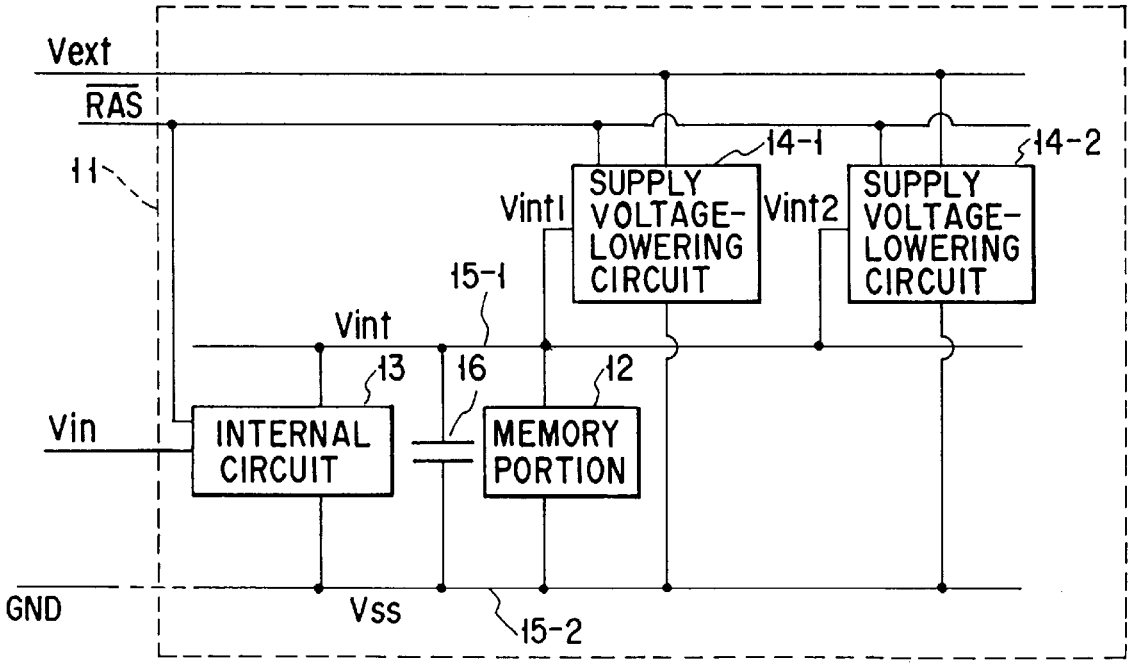
FIG. 6 is a block diagram showing the schematic arrangement of an extracted circuit portion related to supply voltage-lowering circuits of a semiconductor memory device to explain a semiconductor device according to the first embodiment of the present invention.

FIG. 6 is an explanatory view for a semiconductor device according to the first embodiment of the present invention, and shows the schematic arrangement of an extracted circuit portion related to a supply voltage-lowering circuit of a semiconductor memory device. A semiconductor chip 11 receives an external power supply potential Vext, a ground potential GND, an input signal Vin, a chip control signal /RAS, and the like. This chip 11 includes a memory portion 12, an internal circuit 13, supply voltage-lowering circuits 14-1 and 14-2, and the like. The supply voltage-lowering circuits 14-1 and 14-2 step down the external power supply potential Vext supplied to the chip 11 to generate internal power supply potentials Vint1 and Vint2. The internal power supply potentials Vint1 and Vint2 are superposed on each other to obtain an internal power supply potential Vint which is supplied to a power supply line 15-1. The external ground potential GND is applied to a power supply line 15-2 and used as an internal ground potential Vss. With this arrangement, an operation voltage is applied to the memory portion 12 and the internal circuit 13 through the power supply lines 15-1 and 15-2. A capacitor 16 equivalently represents the capacitance between the power supply lines 15-1 and 15-2.

Figure 7:
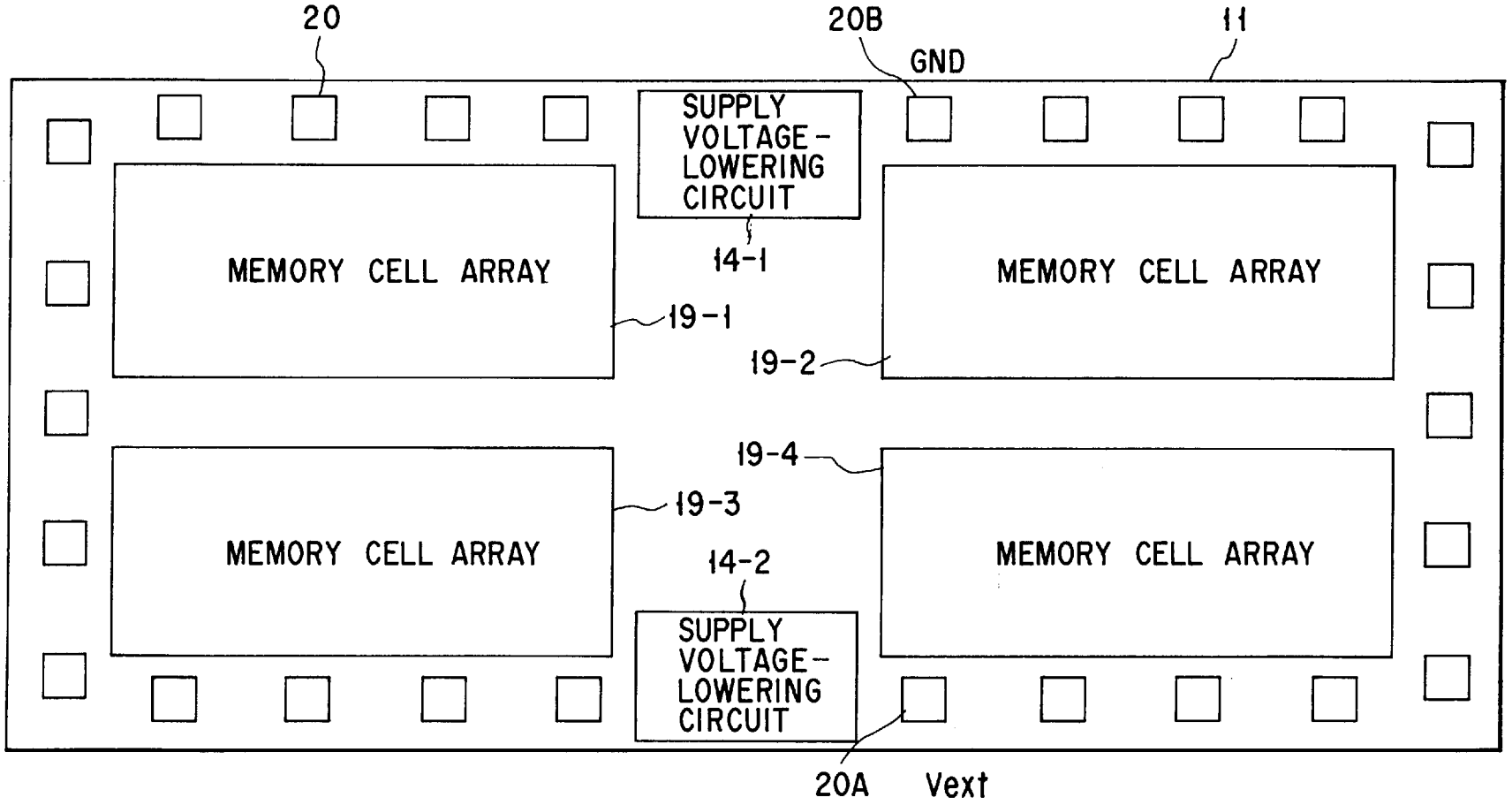
FIG. 7 is a plan view showing an example of the pattern layout of supply voltage-lowering circuits in the circuit shown in FIG. 6.

FIG. 7 shows an example of the pattern layout of the supply voltage-lowering circuits 14-1 and 14-2 in the circuit shown in FIG. 6. The chip 11 comprises four divided memory cell arrays 19-1 to 19-4. Pads 20 are arranged along the four sides of the chip 11 around these memory cell arrays 19-1 to 19-4. The supply voltage-lowering circuits 14-1 and 14-2 are arranged near two opposite sides in the region between the memory cell arrays 19-1 and 19-3 and the memory cell arrays 19-2 and 19-4. Of the pads 20, a pad 20A arranged near the supply voltage-lowering circuit 14-2 serves to input the external power supply potential Vext, and a pad 20B arranged near the supply voltage-lowering circuit 14-1 serves to input the external ground potential GND.

Figure 8:
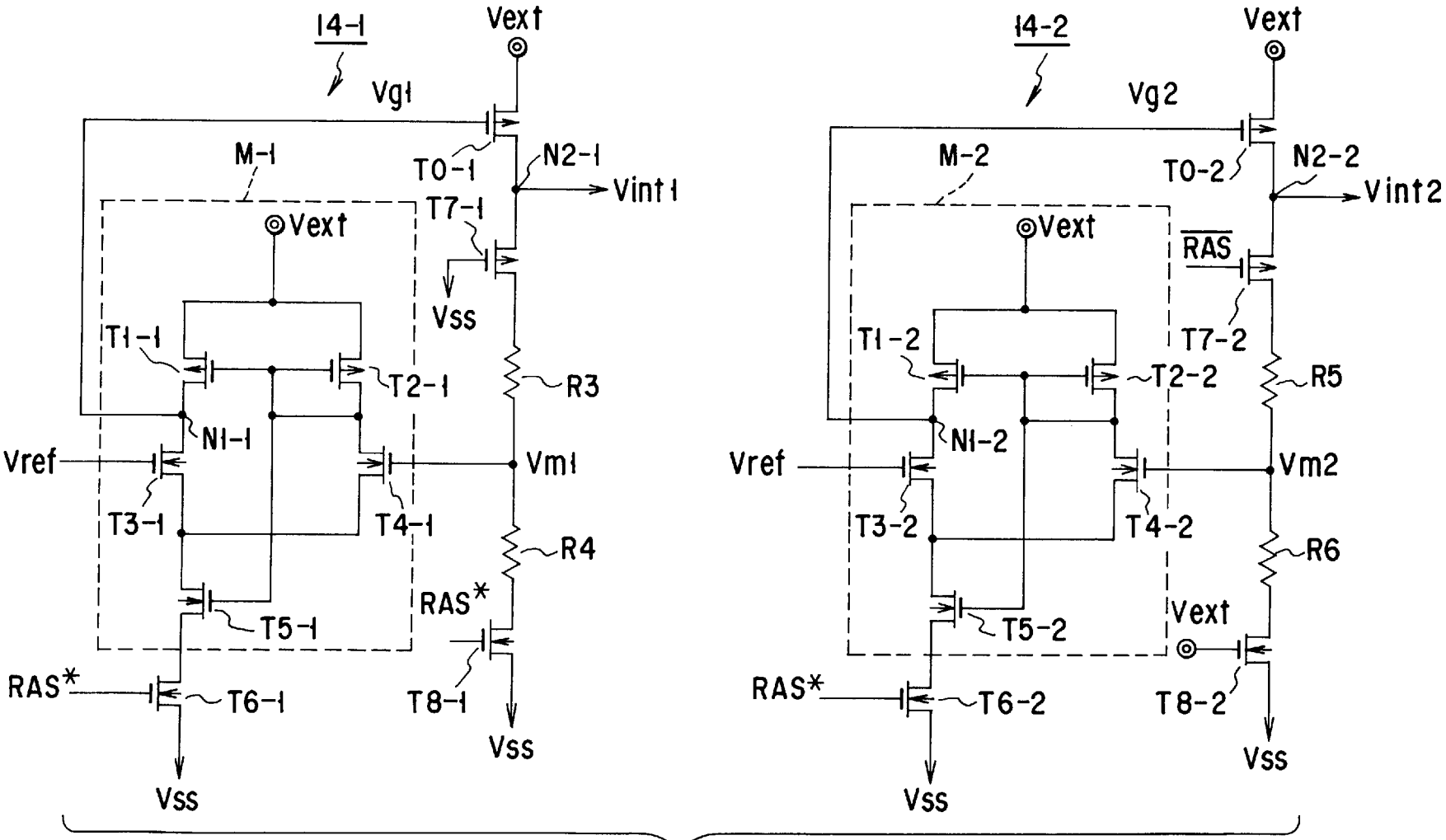
FIG. 8 is a circuit diagram showing an example of the detailed configurations of the supply voltage-lowering circuits in the circuit shown in FIGS. 6 and 7.

FIG. 8 is a circuit diagram showing an example of the detailed arrangements of the supply voltage-lowering circuits 14-1 and 14-2 in the circuit shown in FIGS. 6 and 7. The supply voltage-lowering circuit 14-1 is constituted by a current-mirror differential amplifier M-1 including P-channel MOS transistors T1-i and T2-1 and N-channel MOS transistors T3-1 to T5-1, a P-channel MOS transistor T7-1 which controls the operation of the differential amplifier M-1, N-channel MOS transistors T6-1 and T8-1, a driving P-channel MOS transistor T0-1 for stepping down the external power supply potential Vext to the internal power supply potential Vint1 and supplying the internal power supply potential Vint1 to the memory portion 12 and the internal circuit 13, resistors R3 and R4 which generate a monitor potential Vm1 to monitor the level of the internal power supply potential Vint1, and the like.

The sources of the MOS transistors T1-1 and T2-1 are commonly connected, to the common source connecting point of which the external power supply potential Vext is applied. The drains of the MOS transistors T1-1 and T2-1 are respectively connected to those of the MOS transistors T3-1 and T4-1, and the sources of the MOS transistors T3-1 and T4-1 are commonly connected. The gates of the MOS transistors T1-1 and T2-1 are commonly connected, and this common gate connecting point is connected to the common drain connecting point between the MOS transistors T2-1 and T4-1. A reference potential Vref is applied to the gate of the MOS transistor T3-1, and the monitor potential Vm1 is applied to the gate of the MOS transistor T4-1. The drain of the MOS transistor T5-1 is connected to the source connecting point between the MOS transistors T3-1 and T4-1, its gate is connected to the gate connecting point between the MOS transistors T1-1 and T2-1, and its source is connected to the drain of the MOS transistor T6-1. The internal ground potential Vss is applied to the source of the MOS transistor T6-1, and an internal RAS* signal (signal having a phase opposite to that of the chip control signal /RAS) is supplied to the gate.

The source of the MOS transistor T0-1 receives the external power supply potential Vext, and its gate is connected to an output node N1-1 (drain connecting point between the MOS transistors T1-1 and T3-1) of the differential amplifier M-1. The channel width W of the MOS transistor T0-1 has an optimum value which is determined by the sum of power consumptions of the memory portion 12 and the internal circuit 13. The source of the MOS transistor T7-1 is connected to the drain of the MOS transistor T0-1, and its gate receives the internal ground potential Vss. The internal ground potential Vss is applied to the source of the MOS transistor T8-1, and the chip control signal /RAS is supplied to its gate. The resistors R3 and R4 are series-connected between the drains of the MOS transistors T7-1 and T8-1. The gate of the MOS transistor T4-1 is connected to the connecting point between the resistors R3 and R4 to apply the monitor potential Vm1. The internal power supply potential Vint1 is output from the connecting point (output node N2-1) between the drain of the MOS transistor T0-1 and the source of the MOS transistor T7-1.

On the other hand, the supply voltage-lowering circuit 14-2 is constituted by a current-mirror differential amplifier M-2 including P-channel MOS transistors T1-2 and T2-2 and N-channel MOS transistors T3-2 to T5-2, a P-channel MOS transistor T7-2 which controls the operation of the differential amplifier M-2, N-channel MOS transistors T6-2 and T8-2, a driving P-channel MOS transistor T0-2 for stepping down the external power supply potential Vext to the internal power supply potential Vint2 and supplying the internal power supply potential Vint2 to the memory portion 12 and the internal circuit 13, resistors R5 and R6 which generate a monitor potential Vm2 to monitor the level of the internal power supply potential Vint2, and the like.

The differential amplifier M-2 has substantially the same circuit configuration as that of the differential amplifier M-1. The drain of the MOS transistor T6-2 which controls the operation of the differential amplifier M-2 is connected to the source of the MOS transistor T5-2. The internal ground potential Vss is applied to the source of the MOS transistor 6-2, and the internal RAS* signal is supplied to its gate.

The source of the MOS transistor T0-2 receives the external power supply potential Vext, and its gate is connected to an output node N1-2 of the differential amplifier M-2. The channel width W of the MOS transistor T0-2 has an optimum value which is determined by the sum of power consumptions of the memory portion 12 and the internal circuit 13. The source of the MOS transistor T7-2 is connected to the drain of the MOS transistor T0-2, and its gate receives the chip control signal /RAS. The internal ground potential Vss is applied to the source of the MOS transistor T8-2, and the external power supply potential Vext is applied to its gate. The resistors R5 and R6 are series-connected between the drains of the MOS transistors T7-2 and T8-2. The gate of the MOS transistor T4-2 is connected to the connecting point between the resistors R5 and R6 to apply the monitor potential Vm2. The internal power supply potential Vint2 is output from the connecting point (output node N2-2) between the drain of the MOS transistor T0-2 and the source of the MOS transistor T7-2.

Note that the resistors R3 and R5 have the same resistance value, while the resistors R4 and R6 have the same resistance value.

Figure 9:
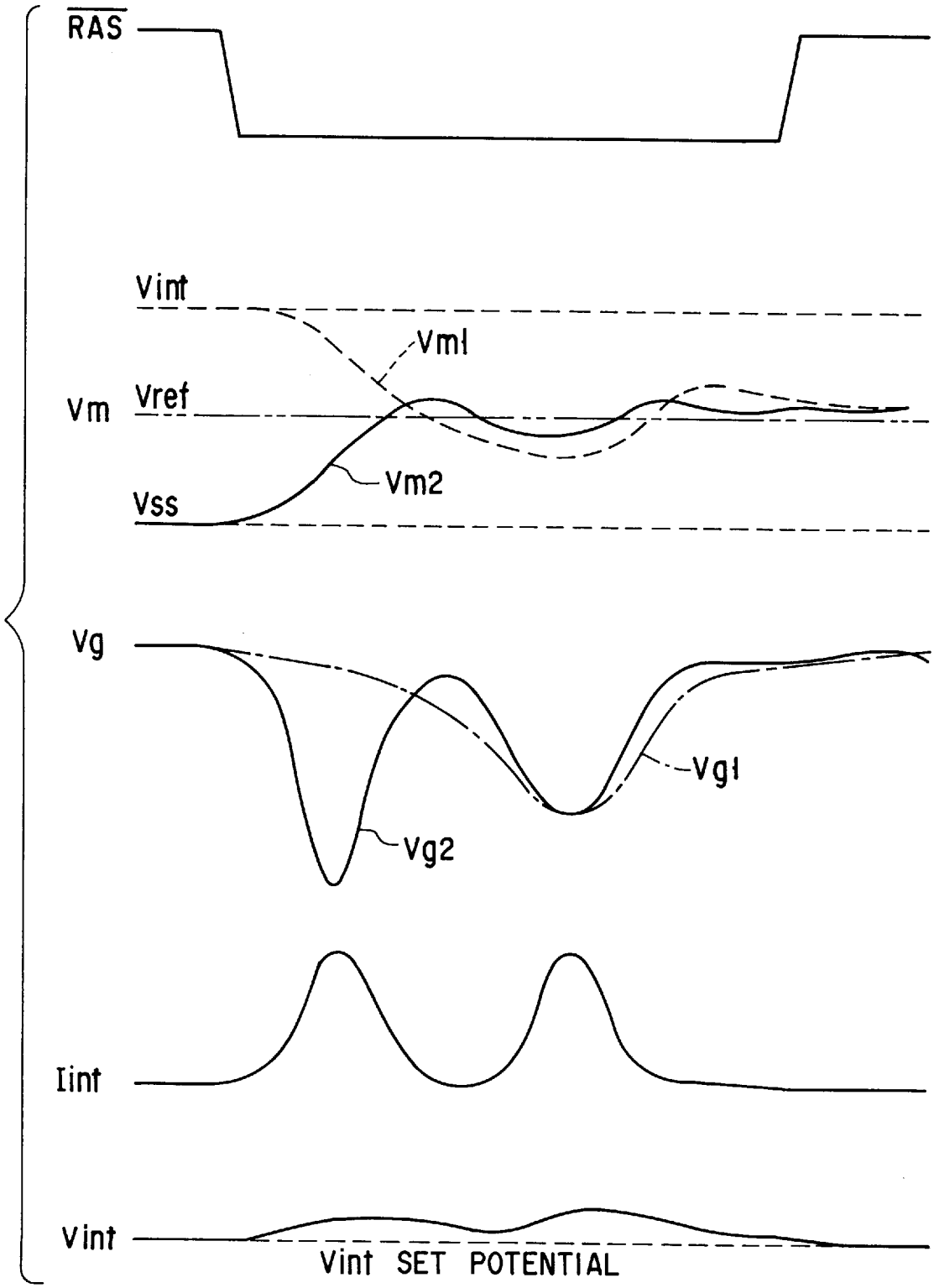
FIG. 9 is a timing chart for explaining the operations of the circuits shown in FIG. 8.

With reference to a timing chart in FIG. 9, the operation of the circuit portion having the above arrangement will be explained. When the chip control signal /RAS is at "H" level (internal RAS* signal is at "L" level), the MOS transistors T6-1, T6-2, and T7-2 are OFF, and the MOS transistors T7-1 and T8-2 are ON, so that both the differential amplifiers M-1 and M-2 are inactive. At this time, the transistors T0-1 and T0-2 are OFF because the output nodes N1-1 and N1-2 of the differential amplifiers M-1 and M-2, i.e., the gate potentials Vg1 and Vg2 of the MOS transistors T0-1 and T0-2 are at "H" level. The monitor potential Vm1 is equal to the internal power supply potential Vint1 because the connecting point between the resistors R3 and R4 is connected to the output node N2-1 through the resistor R3 and the drain-source path of the MOS transistor T7-1. To the contrary, the monitor potential Vm2 is equal to the internal ground potential Vss because the connecting point between the resistors R5 and R6 is grounded through the drain-source path of the MOS transistor T8-2.

When the chip control signal /RAS changes from "H" level to "L" level (internal RAS* signal changes from "L" level to "H" level), the MOS transistors T6-1 and T6-2 are turned on to activate the differential amplifiers M-1 and M-2, and the MOS transistors T7-2 and T8-1 are also turned on. At this time, Vm1>Vref because the monitor potential Vm1 becomes equal to the internal power supply potential Vint1. The output node N1-1 (potential Vg1) of the differential amplifier M-1 remains at "H" level, and the MOS transistor T0-1 remains OFF. On the other hand, Vm2<Vref because the monitor potential Vm2 becomes equal to the internal ground potential Vss. The output node N1-2 (potential Vg2) of the differential amplifier M-2 is inverted to "L" level to turn on the MOS transistor N1-2. With this operation, the output node N2-2 of the supply voltage-lowering circuit 14-2 is charged by the external power supply potential Vext to increase the internal power supply potential Vint2. That is, the power supply line 15-1 is driven by a small driving ability of only the output potential Vint2 of the supply voltage-lowering circuit 14-2 (Vint=Vint2).

Upon turning on the MOS transistor T8-1, the monitor potential Vm1 gradually drops from the standby potential Vint1 to Vint1·r4/(r3+r4) (r3 and r4: resistance values of the resistors R3 and R4). Since Vm1>Vref while the potential Vm1 decreases from the potential Vint1 to Vint1·r4/(r3+r4), the MOS transistor T0-1 remains OFF (this period can be prolonged by setting large resistance values of the resistors R3 and R4 while keeping the resistance ratio r3/r4 constant). When the potential Vm1 falls and Vm1<Vref holds, the MOS transistor T0-1 is turned on, and the output node N2-1 of the supply voltage-lowering circuit 14-1 is charged by the external power supply potential Vext to raise the internal power supply potential Vint1. With this operation, the power supply line 15-1 is driven by the output potential Vint2 of the supply voltage-lowering circuit 14-2 and the output potential Vint1 of the supply voltage-lowering circuit 14-1. When the potential Vint1 increases to Vint1·r4/(r3 +r4)=Vref, Vm1>Vref holds. The output node N1-1 of the differential amplifier M-1 changes to "H" level to turn off the MOS transistor T0-1, which interrupts the supply of electric charges to the output node N2-1 of the supply voltage-lowering circuit 14-1. The power supply line 15-1 is driven again by only the output potential Vint2 of the supply voltage-lowering circuit 14-2. In this way, when the potential of the power supply line 15-1 drops, the supply voltage-lowering circuit 14-1 compensates for this decrease by repeatedly performing the same operation.

In the supply voltage-lowering circuit 14-2, when the potential Vint2 rises from the standby potential Vss to Vint2·r6/(r5+r6)=Vref (r5 and r6: resistance values of the resistors R5 and R6), Vm2>Vref holds. The output node N1-2 of the differential amplifier M-2 changes to "H" level to turn off the MOS transistor T0-2, which interrupts the supply of electric charges to the output node N2-2 of the supply voltage-lowering circuit 14-2. When the potential Vm2 drops and Vm2<Vref holds, the MOS transistor T0-2 is turned on again to repeatedly perform the same operation.

In the above arrangement, the internal power supply potentials Vint1 and Vint2 output from the supply voltage-lowering circuits 14-1 and 14-2 change out of phase with each other (Vint1 and Vint2 are on the same level). Since the potential variations can be canceled out by each other, a stable internal power supply potential Vint can be supplied to the power supply line 15-1. Therefore, a semiconductor device having a supply voltage-lowering circuit which can suppress variations in internal power supply potential and generate a stable internal power supply potential can be provided.

When the present invention is applied to a semiconductor memory device, variations in potential (internal power supply potential) applied to a memory cell may hinder read and write operations of storage information with respect to the memory cell, causing malfunctions. However, variations in internal power supply potential can be minimized to supply a uniform potential in the chip by arranging the supply voltage-lowering circuits 14-1 and 14-2 near the central portion of the chip 11 to be adjacent to the pad 20A for inputting the external power supply potential Vext and the pad 20B for inputting the external ground potential GND, respectively, as shown in FIG. 7. With this arrangement, malfunctions due to variations in internal power supply potential can be suppressed.

Figure 10:
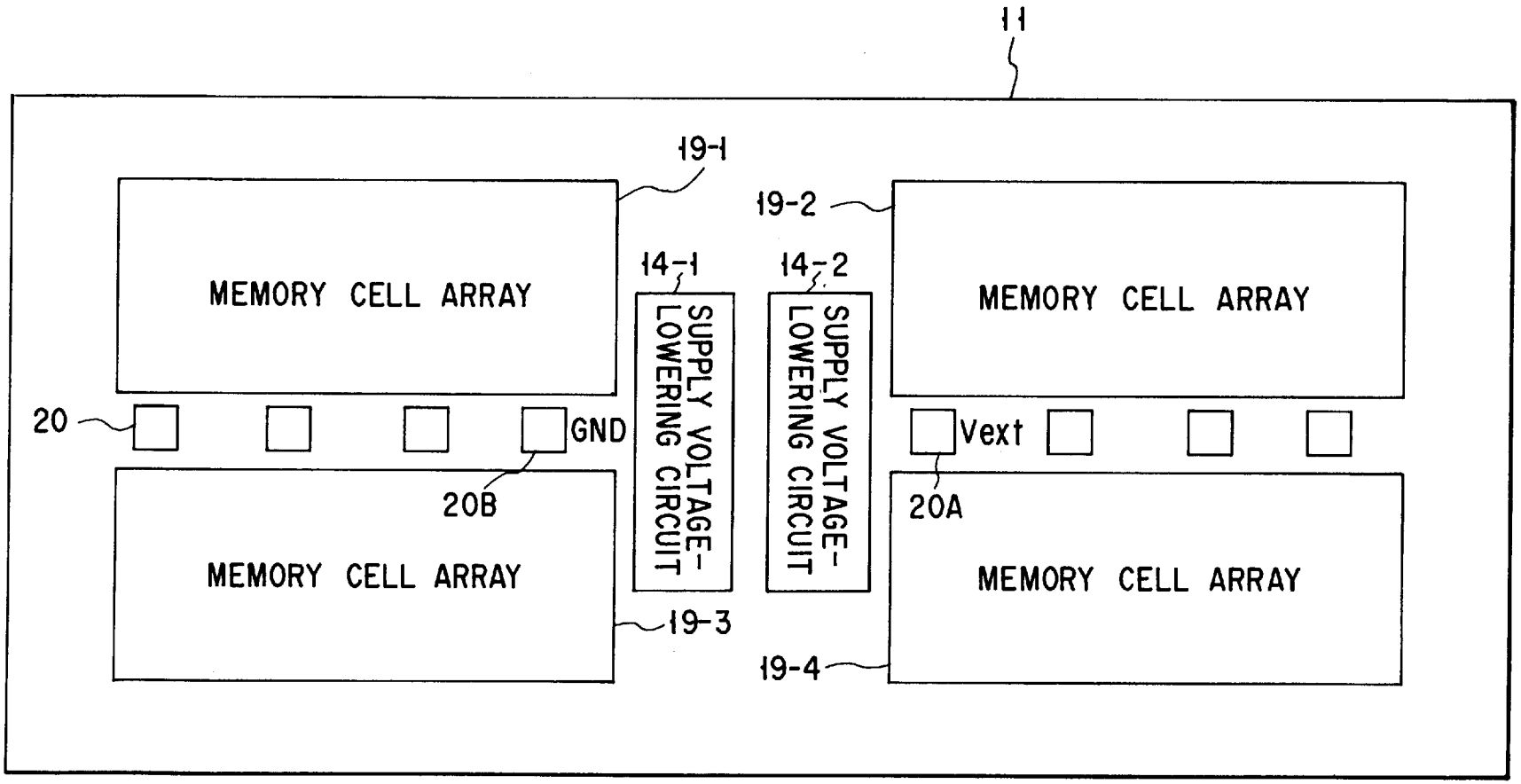
FIG. 10 is a plan view showing another example of the pattern layout of the supply voltage-lowering circuits in the circuit shown in FIG. 6.

FIG. 10 shows another example of the pattern layout of the supply voltage-lowering circuits 14-1 and 14-2 in the circuit shown in FIG. 6. That is, FIG. 7 shows the pattern layout of peripheral pads, whereas FIG. 10 shows a semiconductor memory device having center pads. The same reference numerals in FIG. 10 denote the same parts as in FIG. 7, and a detailed description thereof will be omitted.

In either layout of peripheral pads or center pads, a uniform potential can be supplied in the chip 11 to suppress malfunctions by arranging the supply voltage-lowering circuits 14-1 and 14-2 near the central portion of the chip 11 to be adjacent to the pads 20A and 20B, respectively.

The first embodiment exemplifies the case in which the standby monitor potentials Vm1 and Vm2 of the supply voltage-lowering circuits 14-1 and 14-2 are equal to the internal power supply potential Vint and the internal ground potential Vss, respectively. However, the same operation effect can be obtained even in an arrangement wherein the standby monitor potentials Vm1 and Vm2 are equal to the internal power supply potential Vint and the reference potential Vref, respectively, or the reference potential Vref and the internal ground potential Vss.

Figure 11:
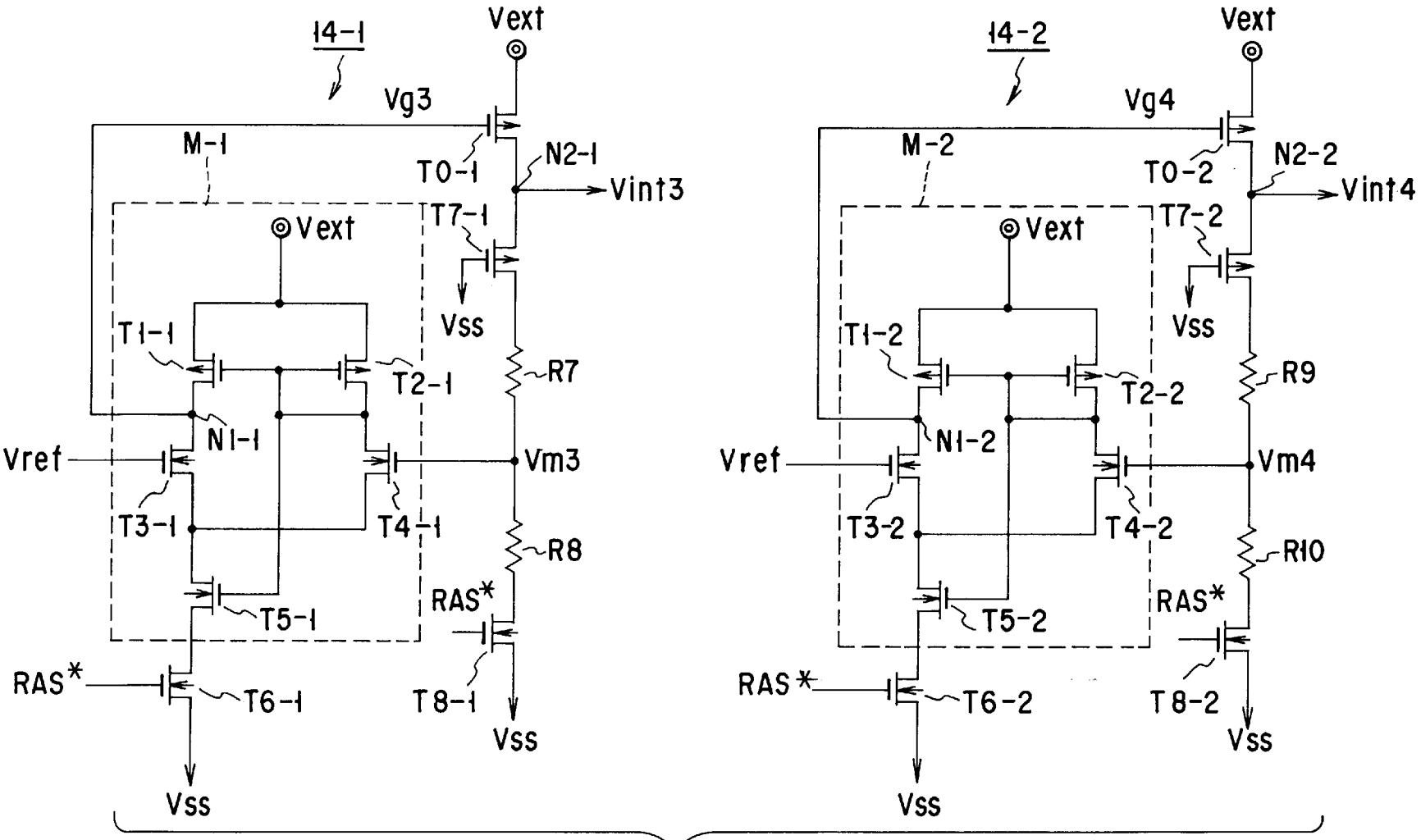
FIG. 11 is a circuit diagram showing another example of the configurations of supply voltage-lowering circuits to explain a semiconductor device according to the second embodiment of the present invention.

FIG. 11 is an explanatory view for a semiconductor device according to the second embodiment of the present invention, and shows another example of the configurations of supply voltage-lowering circuits 14-1 and 14-2. The circuits shown in FIG. 11 are different from those shown in FIG. 8 in that the internal ground potential Vss is applied to the gate of a MOS transistor T7-2, instead of the chip control signal /RAS, and the internal RAS* signal is supplied to the gate of a MOS transistor T8-2, instead of the external power supply potential Vext. Further, resistors R7 and R8 replace the resistors R3 and R4, and resistors R9 and R10 replace the resistors R5 and R6. The resistance ratio r7/r8 of the resistors R7 and R8 is set different from the resistance ratio r9/r10 of the resistors R9 and R10. The level of the monitor potential Vm1 is set different from that of the monitor potential Vm2. With this setting, the operation threshold voltages of the supply voltage-lowering circuits 14-1 and 14-2 change to obtain different operation threshold voltages.

Figure 12:
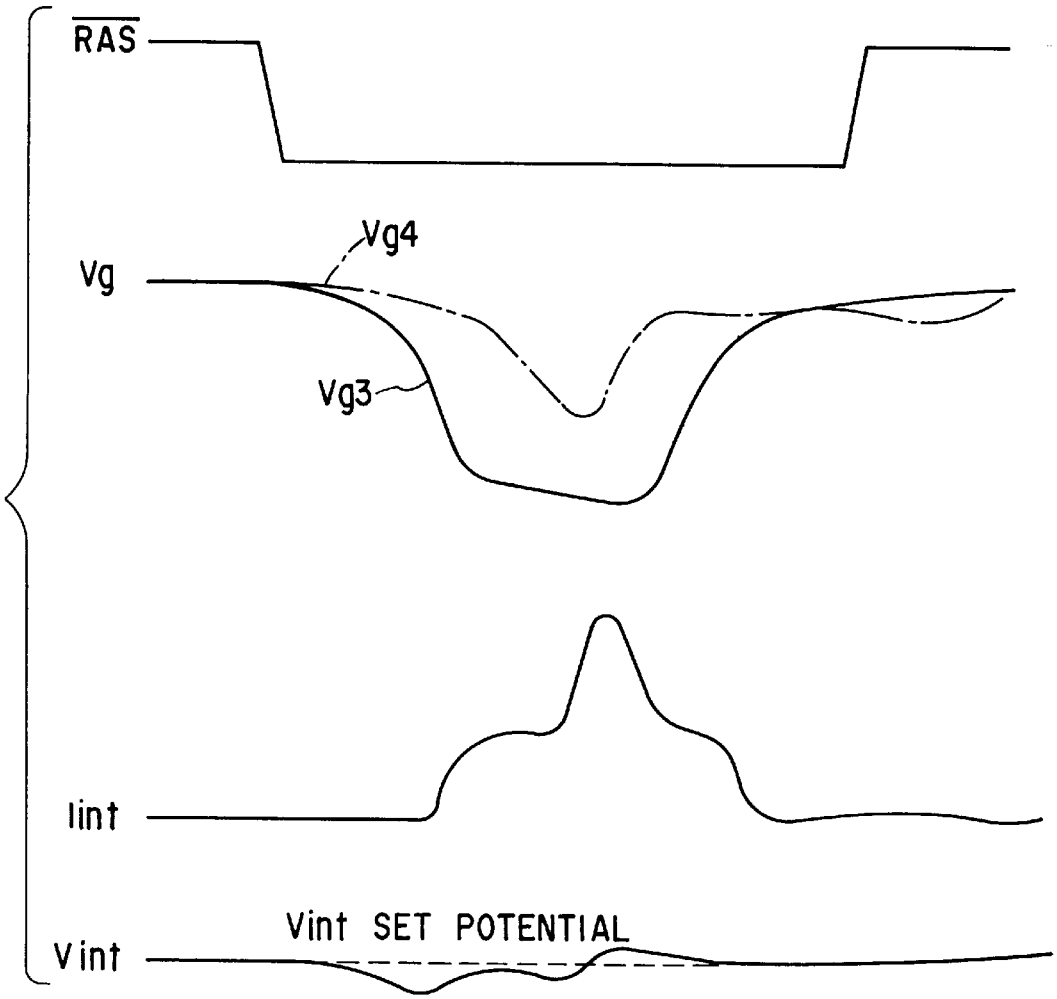
FIG. 12 is a timing chart for explaining the operations of the circuits shown in FIG. 11.
Figure 13:
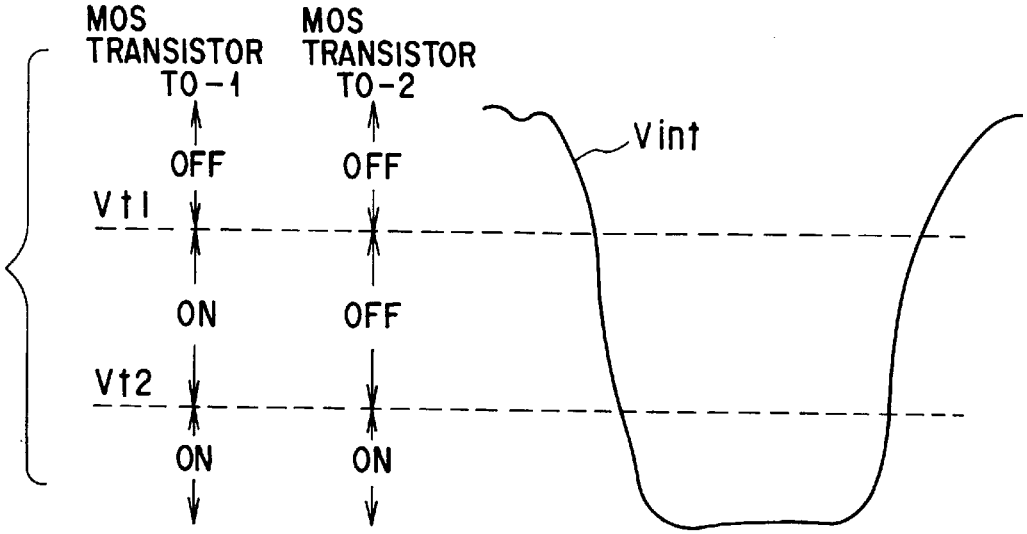
FIG. 13 is a view for explaining the relationship between the internal power supply potential, the circuit threshold voltages of the first and second supply voltage-lowering circuits, and the operation of the driving MOS transistor.

In the above arrangement, as shown in a timing chart of FIG. 12, when the chip control signal /RAS changes from "H" level to "L" level (internal RAS* signal changes from "L" level to "H" level), differential amplifiers M-1 and M-2 are activated. MOS transistors T8-1 and T8-2 are turned on, and the monitor potentials Vm3 and Vm4 drop from the standby internal power supply potentials Vint3 and Vint4 to Vint3·r8/(r7+r8) and Vint4·r10/(r9 +r10), respectively. Assuming that the resistance ratio r7/r8 of the resistors R7 and R8 and the resistance ratio r9/r10 of the resistors R9 and R10 satisfy r7/r8<r9/r10, Vm5>Vm6 holds. The circuit threshold voltage Vt1 of the supply voltage-lowering circuit 14-1 is different from the circuit threshold voltage Vt2 of the supply voltage-lowering circuit 14-2. As shown in FIG. 13, a MOS transistor T0-1 is turned on and off faster than a MOS transistor T0-2. Therefore, in accordance with the level of the internal power supply potential Vint, the supply voltage-lowering circuits 14-1 and 14-2 operate in any one of three states, i.e., neither of the supply voltage-lowering circuits 14-1 and 14-2 operate (Vint>Vt1); the supply voltage-lowering circuit 14-1 operates, while the supply voltage-lowering circuit 14-2 does not operate (Vt1>Vint>Vt2); and both the supply voltage-lowering circuits 14-1 and 14-2 operate (Vt2>Vint).

With this operation, the internal power supply potential Vint3 of the supply voltage-lowering circuit 14-1 and the internal power supply potential Vint4 of the supply voltage-lowering circuit 14-2 vary out of phase with each other. As a result, phase shifts can be canceled out by each other, and a stable internal power supply potential Vint can be supplied.

Figure 14:
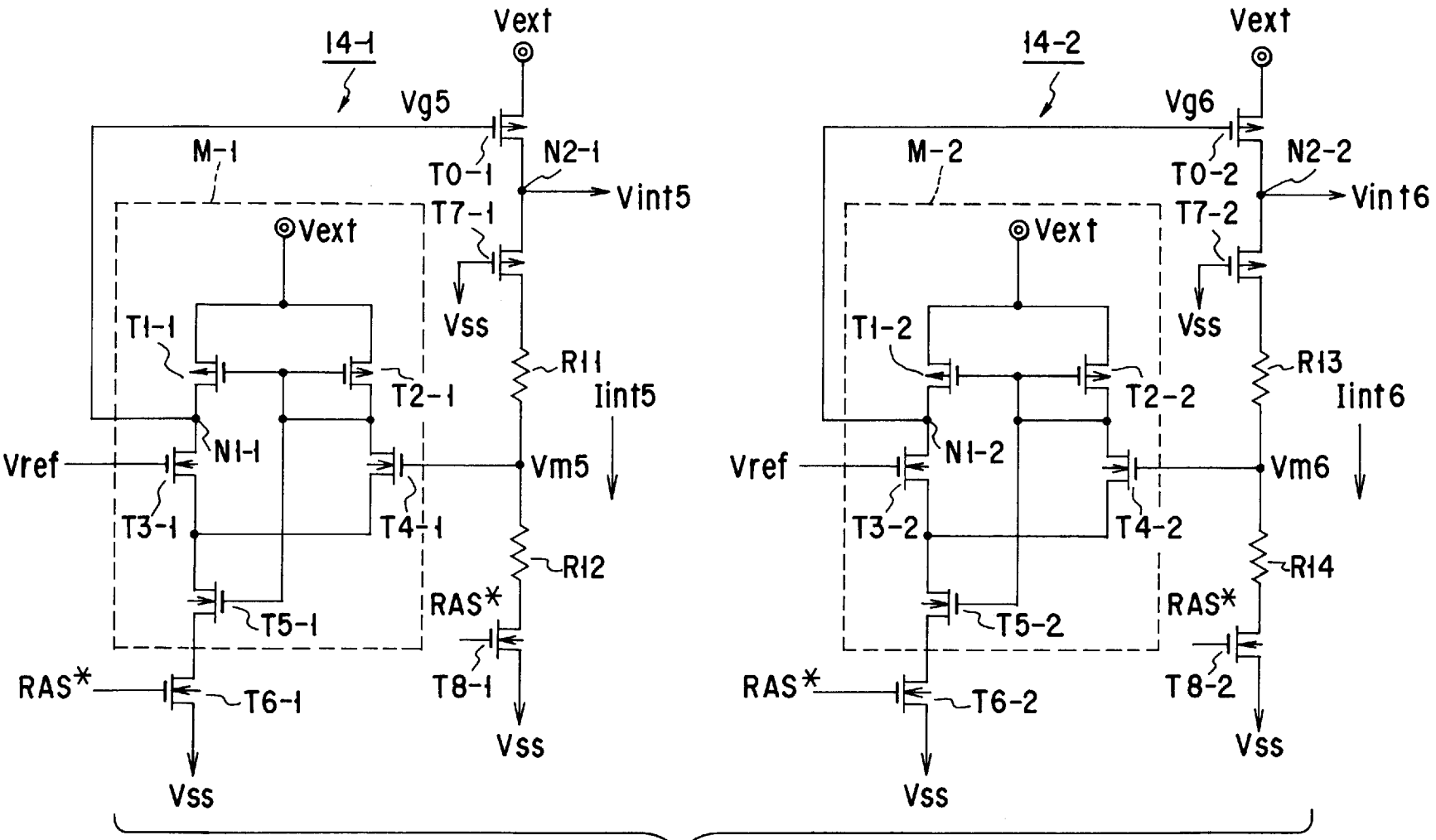
FIG. 14 is a circuit diagram showing still another example of the configurations of supply voltage-lowering circuits to explain a semiconductor device according to the third embodiment of the present invention.

FIG. 14 is an explanatory view for a semiconductor device according to the third embodiment of the present invention, and shows still another example of the arrangements of supply voltage-lowering circuits 14-1 and 14-2. The circuits shown in FIG. 14 are different from those shown in FIG. 11 in that resistors R11 and R12 replace the resistors R7 and R8, resistors R13 and R14 replace the resistors R9 and R10, the resistance ratio r11/r12 of the resistors R11 and R12 is set equal to the resistance ratio r13/r14 of the resistors R13 and R14, and the sum of the resistances of the resistors R11 and R12 is set different from that of the resistors R13 and R14, thereby flowing different currents Iint5 and Iint6 through the resistors R11 and R12 and the resistors R13 and R14, respectively. With this setting, the response speeds of supply voltage-lowering circuits 14-1 and 14-2 become different from each other.

In this embodiment, by setting r11<r13 and r11/r12=r13/r14, the time constants of Vm5 and Vm6 obtained by dividing the internal power supply potentials Vint5 and Vint6 are so set that the supply voltage-lowering circuit 14-1 has a quick response characteristic and the supply voltage-lowering circuit 14-2 has a slow response characteristic, thus generating a phase difference between the internal power supply potentials Vint5 and Vint6.

Figure 15:
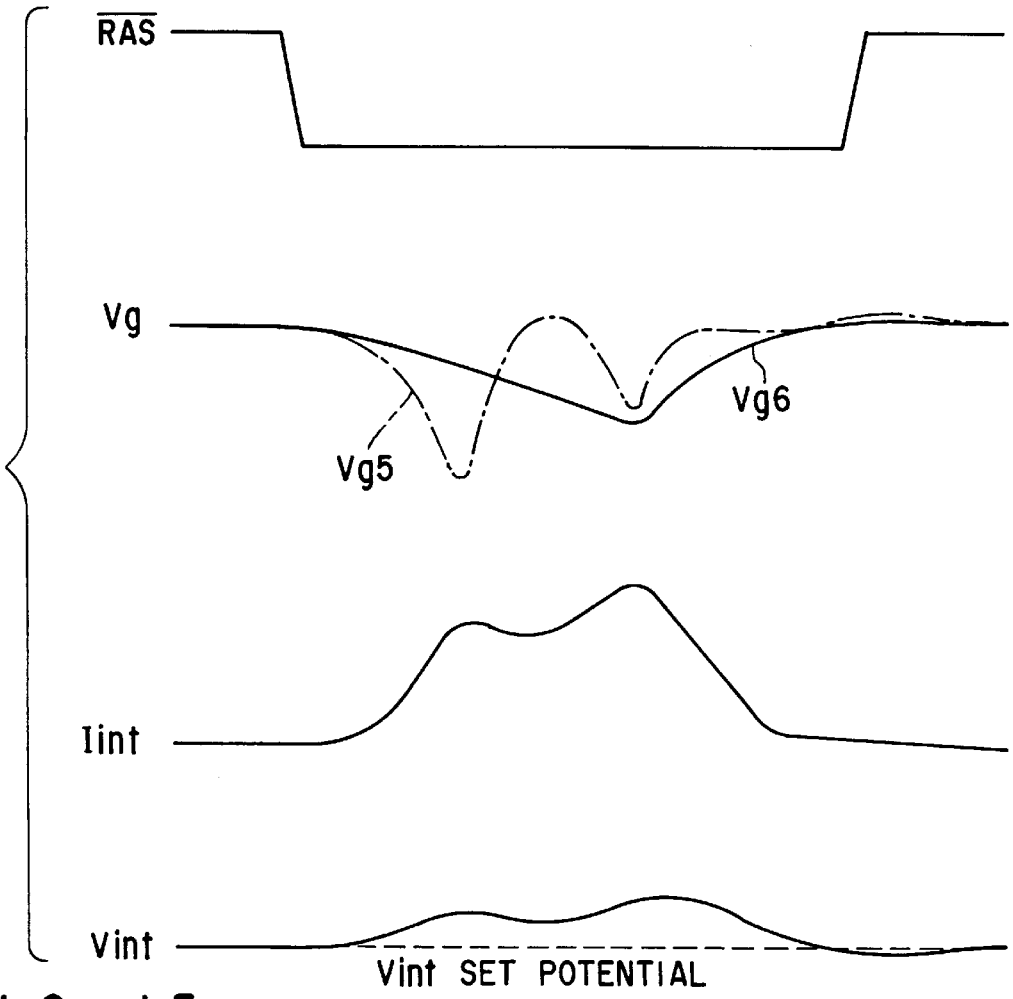
FIG. 15 is a timing chart for explaining the operations of the circuits shown in FIG. 14.

In the above arrangement, as shown in a timing chart of FIG. 15, when the chip control signal /RAS changes from "H" level to "L" level (internal RAS* signal changes from "L" level to "H" level), differential amplifiers M-1 and M-2 are activated, and MOS transistors T8-1 and T8-2 are turned on. The monitor potential Vm5 drops from the standby internal power supply potential Vint5 to Vint5·r12/(r11+r12), while the monitor potential Vm6 drops from the standby internal power supply potential Vint6 to Vint6·r14/(r13+r14). At this time, the current Iint5 flowing through the resistors R11 and R12 is determined by the internal power supply potential Vint5 and the sum r11+r12 of the resistance values of the resistors R11 and R12. The current Iint6 flowing through the resistors R13 and R14 is determined by the internal power supply potential Vint6 and the sum r13+r14 of the resistance values of the resistors R13 and R14. Since r11+r12<r13+r14, Iint5<Iint6, and the monitor potential Vm5 settles from Vm5=Vint5 to a normal state Vm5=Vref faster than the monitor potential Vm6. As for the response of the monitor potential Vm to the internal power supply potential Vint when electric charges are consumed in a chip 11 to decrease the internal power supply potential Vint, the potential Vm5 falls within the range Vm<Vref faster than the potential Vm6.

The output potential Vint5 of the supply voltage-lowering circuit 14-1 varies at a short period, while the output potential Vint6 of the supply voltage-lowering circuit 14-2 varies at a long period. Thus, the phase shifts of the potentials Vint5 and Vint6 can be canceled out by each other, and a stable internal power supply potential Vint can be supplied.

Figure 16:
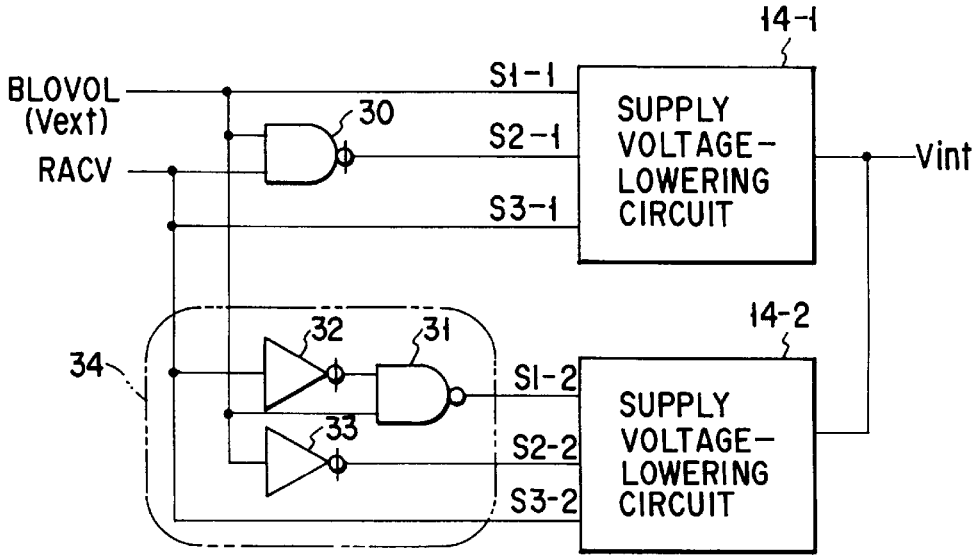
FIG. 16 is a block diagram showing the schematic arrangement of an extracted circuit portion related to supply voltage-lowering circuits to explain a semiconductor device according to the fourth embodiment of the present invention.

Note that the first to third embodiments exemplify the semiconductor memory device, but the present invention can be generally applied to other semiconductor devices. FIG. 16 is an explanatory view for a semiconductor device according to the fourth embodiment of the present invention, and shows first and second supply voltage-lowering circuits and a control circuit for controlling the operations of these supply voltage-lowering circuits. The control circuit is constituted by NAND gates 30 and 31 and inverters 32 and 33. A signal BLOVOL (=external power supply potential Vext) is supplied to a first input terminal S1-1 of a supply voltage-lowering circuit 14-1, the one input terminal of each of the NAND gates 30 and 31, and the input terminal of the inverter 33. A signal RACV for controlling activation/inactivation of the supply voltage-lowering circuits 14-1 and 14-2 is supplied to the other input terminal of the NAND gate 30, an input terminal S3-1 of the supply voltage-lowering circuit 14-1, the input terminal of the inverter 32, and an input terminal S3-2 of the supply voltage-lowering circuit 14-2. The output signal from the NAND gate 30 is supplied to the supply voltage-lowering circuit 14-1. The output signal from the inverter 32 is supplied to the other input terminal of the NAND gate 31, and the output signal from the NAND gate 31 is supplied to an input terminal S1-2 of the supply voltage-lowering circuit 14-2. The output signal from the inverter 33 is supplied to an input terminal S2-2 of the supply voltage-lowering circuit 14-2. The output terminals of the supply voltage-lowering circuits 14-1 and 14-2 are commonly connected. The output potential Vint of the supply voltage-lowering circuits 14-1 and 14-2 is supplied as an operation power supply to an internal circuit (not shown). Note that the NAND gate 31 and the inverters 32 and 33 surrounded by a chain double-dashed line have a CMOS structure, and the potential Vext is applied to the source and backgate of a P-channel MOS transistor.

Figure 17:
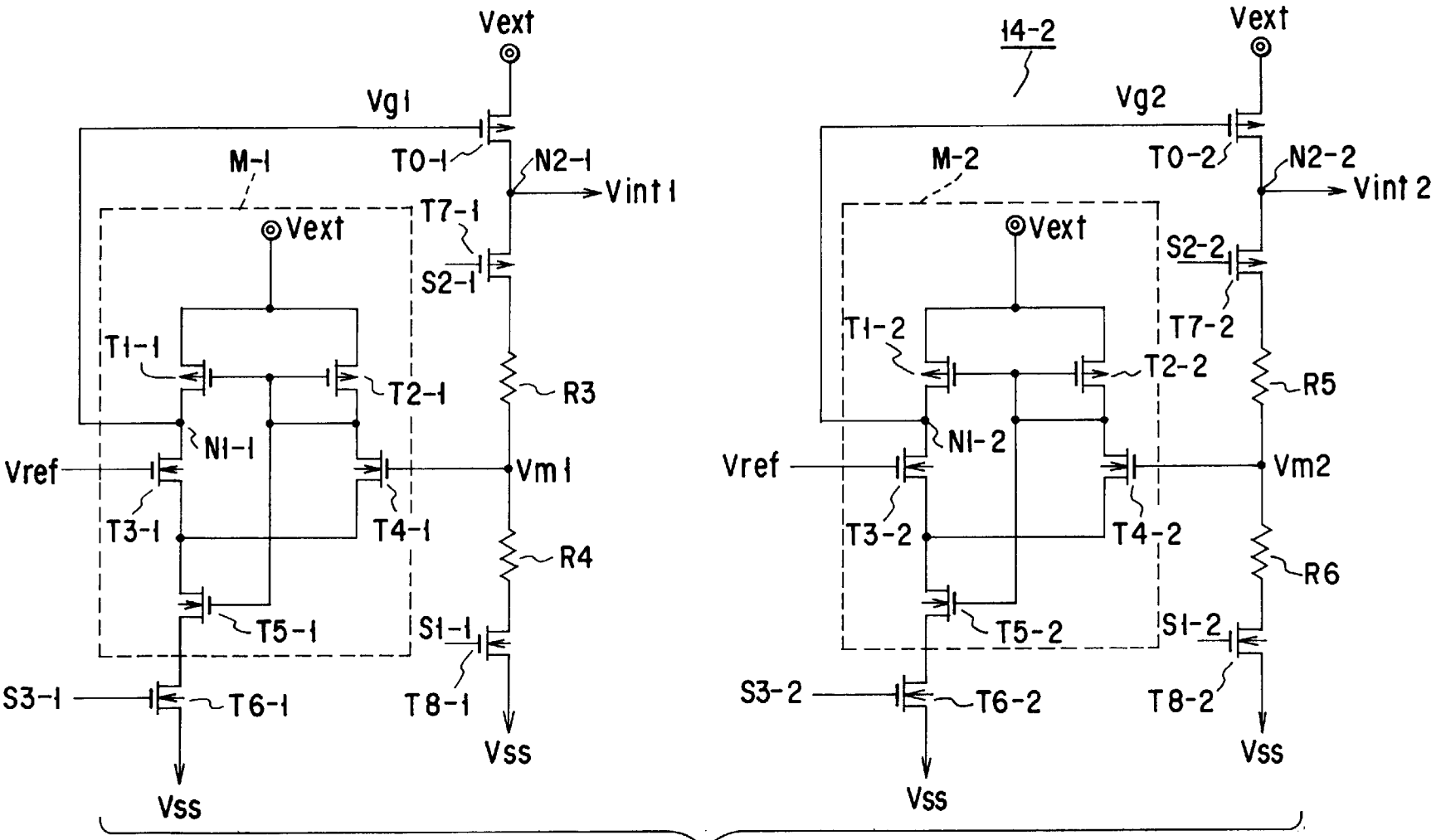
FIG. 17 is a circuit diagram showing an example of the configurations of the supply voltage-lowering circuits in the circuit shown in FIG. 16.

As shown in FIG. 17, the supply voltage-lowering circuits 14-1 and 14-2 basically have the same circuit configurations as those in the first to third embodiments described above. The gate electrode of the MOS transistor T8-1 corresponds to the first input terminal S1-1 of the supply voltage-lowering circuit 14-1 in FIG. 16, the gate electrode of the MOS transistor T7-1 corresponds to a second input terminal S2-1, and the gate electrode of the MOS transistor T6-1 corresponds to the third input terminal S3-1. The gate electrode of the MOS transistor T8-2 corresponds to the first input terminal S1-2 of the supply voltage-lowering circuit 14-2 in FIG. 16, the gate electrode of the MOS transistor T7-2 corresponds to its second input terminal S2-2, and the gate electrode of the MOS transistor S6-2 corresponds to its third input terminal S3-2. On the basis of the signal BLOVOL (external power supply potential Vext) and the control signal RACV, the supply voltage-lowering circuits 14-1 and 14-2 perform substantially the same operations as those in the first embodiment.

With this arrangement, the supply voltage-lowering circuits 14-1 and 14-2 can be controlled using the control signal RACV. Therefore, the present invention can be easily applied to semiconductor devices other than the semiconductor memory device, and substantially the same operation effects as those in the first to third embodiments described above can be obtained.

As has been described above, according to the present invention, a semiconductor device having a supply voltage-lowering circuit which can suppress variations in internal power supply potential and generate a stable internal power supply potential can be obtained.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A semiconductor device comprising:

a semiconductor chip;

an internal circuit arranged in said semiconductor chip;

a first supply voltage-lowering circuit arranged in said semiconductor chip to step down an external power supply potential of said semiconductor chip in response to a control signal, generate a first internal power supply potential, and supply the first internal power supply potential to said internal circuit; and a second supply voltage-lowering circuit arranged in said semiconductor chip to step down the external power supply potential of said semiconductor chip in response to the control signal, generate a second internal power supply potential of substantially the same level as that of the first internal power supply potential, and supply the second internal power supply potential to said internal circuit, wherein the first and second internal power supply potentials output from said first and second supply voltage-lowering circuits operate out of phase with each other to cancel out variations in first and second internal power supply potentials.

2. A device according to claim 1, wherein said first supply voltage-lowering circuit comprises first charge means for receiving the external power supply potential and charging a first output node to generate the first internal power supply potential, first voltage divider means for dividing the potential of the output node to generate a first monitor potential, and first compare means for comparing the output potential of said first divider means with a reference potential to control said first charge means, and said second supply voltage-lowering circuit comprises second charge means for receiving the external power supply potential and charging a second output node to generate the second internal power supply potential, second voltage divider means for dividing the potential of the second output node to generate a second monitor potential, and second compare means for comparing the output potential of said second divider means with the reference potential to control said second charge means.

3. A device according to claim 2, wherein said first charge means is a first MOS transistor of a first conductivity type in which the external power supply potential is applied to one end of a current path, the other end of the current path is connected to the first output node, and a gate receives a comparison output from said first compare means, and said second charge means is a second MOS transistor of the first conductivity type in which the external power supply potential is applied to one end of a current path, the other end of the current path is connected to the second output node, and a gate receives a comparison output from said second compare means.

4. A device according to claim 2, wherein said first voltage divider means comprises a third MOS transistor of a first conductivity type in which one end of a current path is connected to the first output node and a gate receives an internal ground potential, a fourth MOS transistor of a second conductivity type in which one end of a current path receives the internal ground potential and a gate receives a signal having a phase opposite to that of the control signal, and first and second load elements series-connected between the other end of the current path of said third MOS transistor and the other end of the current path of said fourth MOS transistor, and outputs the first monitor potential from a connecting point between said first and second load elements, and said second voltage divider means comprises a fifth MOS transistor of the first conductivity type in which one end of a current path is connected to the second output node and a gate receives the control signal, a sixth MOS transistor of the second conductivity type in which one end of a current path receives the internal ground potential and a gate receives the external power supply potential, and third and fourth load elements series-connected between the other end of the current path of said fifth MOS transistor and the other end of the current path of said sixth MOS transistor, and outputs the second monitor potential from a connecting point between said third and fourth load elements.

5. A device according to claim 4, wherein a ratio of resistance values of said first and second load elements is equal to a ratio of resistance values of said third and fourth load elements.

6. A device according to claim 2, wherein each of said first and second compare means comprises a seventh MOS transistor of a first conductivity type in which the external power supply potential is applied to one end of a current path, an eighth MOS transistor of the first conductivity type in which the external power supply potential is applied to one end of a current path and a gate is connected to a gate of said seventh MOS transistor, a ninth MOS transistor of a second conductivity type in which one end of a current path is connected to the other end of the current path of said seventh MOS transistor and a gate receives a reference potential, a 10th MOS transistor of the second conductivity type in which one end of a current path is connected to the other end of the current path of said eighth MOS transistor and the gates of said seventh and eighth MOS transistors, the other end of the current path is connected to the other end of the current path of said ninth MOS transistor, and a gate receives a monitor potential, an 11th MOS transistor of the first conductivity type in which one end of a current path is connected to the other end of each of the current paths of said ninth and 10th MOS transistors and a gate is connected to the gates of said seventh and eighth MOS transistors, and a 12th MOS transistor of the first conductivity type in which one end of a current path is connected to the other end of the current path of said 11th MOS transistor, the internal ground potential is applied to the other end of the current path, and a gate receives a signal having a phase opposite to that of the control signal.

7. A semiconductor device comprising:

a semiconductor chip;

an internal circuit arranged in said semiconductor chip;

a first supply voltage-lowering circuit arranged in said semiconductor chip to step down an external power supply potential of said semiconductor chip in response to a control signal, generate a first internal power supply potential, and supply the first internal power supply potential to said internal circuit; and a second supply voltage-lowering circuit arranged in said semiconductor chip to step down the external power supply potential of said semiconductor chip in response to the control signal, generate a second internal power supply potential of substantially the same level as that of the first internal power supply potential, and supply the second internal power supply potential to said internal circuit, wherein said first and second supply voltage-lowering circuits have different operation threshold voltages, and the first and second internal power supply potentials are out of phase to cancel out variations in first and second internal power supply potentials.

8. A device according to claim 7, wherein said first supply voltage-lowering circuit comprises first charge means for receiving the external power supply potential and charging a first output node to generate the first internal power supply potential, first voltage divider means for dividing the potential of the output node to generate a first monitor potential, and first compare means for comparing the output potential of said first divider means with a reference potential to control said first charge means, and said second supply voltage-lowering circuit comprises second charge means for receiving the external power supply potential and charging a second output node to generate the second internal power supply potential, second voltage divider means for dividing the potential of the second output node to generate a second monitor potential, and second compare means for comparing the output potential of said second divider means with the reference potential to control said second charge means.

9. A device according to claim 8, wherein said first charge means is a first MOS transistor of a first conductivity type in which the external power supply potential is applied to one end of a current path, the other end of the current path is connected to the first output node, and a gate receives a comparison output from said first compare means, and said second charge means is a second MOS transistor of the first conductivity type in which the external power supply potential is applied to one end of a current path, the other end of the current path is connected to the second output node, and a gate receives a comparison output from said second compare means.

10. A device according to claim 8, wherein said first voltage divider means comprises a third MOS transistor of a first conductivity type in which one end of a current path is connected to the first output node and a gate receives an internal ground potential, a fourth MOS transistor of a second conductivity type in which one end of a current path receives the internal ground potential and a gate receives a signal having a phase opposite to that of the control signal, and first and second load elements series-connected between the other end of the current path of said third MOS transistor and the other end of the current path of said fourth MOS transistor, and outputs the first monitor potential from a connecting point between said first and second load elements, said second voltage divider means comprises a fifth MOS transistor of the first conductivity type in which one end of a current path is connected to the second output node and a gate receives the internal ground potential, a sixth MOS transistor of the second conductivity type in which one end of a current path receives the internal ground potential and a gate receives a signal having a phase opposite to that of the control signal, and third and fourth load elements series-connected between the other end of the current path of said fifth MOS transistor and the other end of the current path of said sixth MOS transistor, and outputs the second monitor potential from a connecting point between said third and fourth load elements, and the first monitor potential is different from the second monitor potential.

11. A device according to claim 10, wherein a ratio of resistance values of said first and second load elements is different from a ratio of resistance values of said third and fourth load elements.

12. A device according to claim 8, wherein each of said first and second compare means comprises a seventh MOS transistor of a first conductivity type in which the external power supply potential is applied to one end of a current path, an eighth MOS transistor of the first conductivity type in which the external power supply potential is applied to one end of a current path and a gate is connected to a gate of said seventh MOS transistor, a ninth MOS transistor of a second conductivity type in which one end of a current path is connected to the other end of the current path of said seventh MOS transistor and a gate receives a reference potential, a 10th MOS transistor of the second conductivity type in which one end of a current path is connected to the other end of the current path of said eighth MOS transistor and the gates of said seventh and eighth MOS transistors, the other end of the current path is connected to the other end of the current path of said ninth MOS transistor, and a gate receives a monitor potential, an 11th MOS transistor of the first conductivity type in which one end of a current path is connected to the other end of each of the current paths of said ninth and 10th MOS transistors and a gate is connected to the gates of said seventh and eighth MOS transistors, and a 12th MOS transistor of the first conductivity type in which one end of a current path is connected to the other end of the current path of said 11th MOS transistor, the internal ground potential is applied to the other end of the current path, and a gate receives a signal having a phase opposite to that of the control signal.

13. A semiconductor device comprising:

a semiconductor chip;

an internal circuit arranged in said semiconductor chip;

a first supply voltage-lowering circuit arranged in said semiconductor chip to step down an external power supply potential of said semiconductor chip in response to a control signal, generate a first internal power supply potential, and supply the first internal power supply potential to said internal circuit; and a second supply voltage-lowering circuit arranged in said semiconductor chip to step down the external power supply potential of said semiconductor chip in response to the control signal, generate a second internal power supply potential of substantially the same as the first internal power supply potential, and supply the second internal power supply potential to said internal circuit, wherein said first and second supply voltage-lowering circuits have different response speeds to generate a phase difference between the first and second internal power supply potentials to cancel out variations in first and second internal power supply potentials.

14. A device according to claim 13, wherein said first supply voltage-lowering circuit comprises first charge means for receiving the external power supply potential and charging a first output node to generate the first internal power supply potential, first voltage divider means for dividing the potential of the output node to generate a first monitor potential, and first compare means for comparing the output potential of said first divider means with a reference potential to control said first charge means, and said second supply voltage-lowering circuit comprises second charge means for receiving the external power supply potential and charging a second output node to generate the second internal power supply potential, second voltage divider means for dividing the potential of the second output node to generate a second monitor potential, and second compare means for comparing the output potential of said second divider means with the reference potential to control said second charge means.

15. A device according to claim 14, wherein said first charge means is a first MOS transistor of a first conductivity type in which the external power supply potential is applied to one end of a current path, the other end of the current path is connected to the first output node, and a gate receives a comparison output from said first compare means, and said second charge means is a second MOS transistor of the first conductivity type in which the external power supply potential is applied to one end of a current path, the other end of the current path is connected to the second output node, and a gate receives a comparison output from said second compare means.

16. A device according to claim 14, wherein said first voltage divider means comprises a third MOS transistor of a first conductivity type in which one end of a current path is connected to the first output node and a gate receives an internal ground potential, a fourth MOS transistor of a second conductivity type in which one end of a current path receives the internal ground potential and a gate receives a signal having a phase opposite to that of the control signal, and first and second load elements series-connected between the other end of the current path of said third MOS transistor and the other end of the current path of said fourth MOS transistor, and outputs the first monitor potential from a connecting point between said first and second load elements, said second voltage divider means comprises a fifth MOS transistor of the first conductivity type in which one end of a current path is connected to the second output node and a gate receives the internal ground potential, a sixth MOS transistor of the second conductivity type in which one end of a current path receives the internal ground potential and a gate receives a signal having a phase opposite to that of the control signal, and third and fourth load elements series-connected between the other end of the current path of said fifth MOS transistor and the other end of the current path of said sixth MOS transistor, and outputs the second monitor potential from a connecting point between said third and fourth load elements, and a current flowing through said first and second load elements is different from a current flowing through said third and fourth load elements.

17. A device according to claim 16, wherein a ratio of resistance values of said first and second load elements is equal to a ratio of resistance values of said third and fourth load elements, and a sum of the resistance values of said first and second load elements is different from a sum of the resistance values of said third and fourth load elements.

18. A device according to claim 14, wherein each of said first and second compare means comprises a seventh MOS transistor of a first conductivity type in which the external power supply potential is applied to one end of a current path, an eighth MOS transistor of the first conductivity type in which the external power supply potential is applied to one end of a current path and a gate is connected to a gate of said seventh MOS transistor, a ninth MOS transistor of a second conductivity type in which one end of a current path is connected to the other end of the current path of said seventh MOS transistor and a gate receives a reference potential, a 10th MOS transistor of the second conductivity type in which one end of a current path is connected to the other end of the current path of said eighth MOS transistor and the gates of said seventh and eighth MOS transistors, the other end of the current path is connected to the other end of the current path of said ninth MOS transistor, and a gate receives a monitor potential, an 11th MOS transistor of the first conductivity type in which one end of a current path is connected to the other end of each of the current paths of said ninth and 10th MOS transistors and a gate is connected to the gates of said seventh and eighth MOS transistors, and a 12th MOS transistor of the first conductivity type in which one end of a current path is connected to the other end of the current path of said 11th MOS transistor, the internal ground potential is applied to the other end of the current path, and a gate receives a signal having a phase opposite to that of the control signal.

19. A semiconductor memory device comprising:

a semiconductor chip;

a plurality of memory cell arrays arranged in said semiconductor chip and divided into at least two subarrays in vertical and horizontal directions;

pads arranged along at least two opposite sides of said semiconductor chip around the plurality of memory cell arrays;

a first supply voltage-lowering circuit arranged in said semiconductor chip to step down an external power supply potential of said semiconductor chip in response to a control signal, generate a first internal power supply potential, and supply the first internal power supply potential to the memory cell arrays; and a second supply voltage-lowering circuit arranged in said semiconductor chip to step down the external power supply potential of said semiconductor chip in response to the control signal, generate a second internal power supply potential of substantially the same level as that of the first internal power supply potential, and supply the second internal power supply potential to the memory cell arrays, said second supply voltage-lowering circuit canceling out variation in first internal power supply potential by variation in second internal power supply potential, wherein said first and second supply voltage lowering circuits are respectively arranged near center pads on the two opposite sides of the semiconductor chip to be adjacent each other, pads near said first and second supply voltage-lowering circuits receive the external power supply potential and an external ground potential.

20. A device according to claim 19, wherein the first and second internal power supply potentials output from said first and second supply voltage-lowering circuits change out of phase with each other to cancel out variations in first and second internal power supply potentials.

21. A device according to claim 19, wherein said first and second supply voltage-lowering circuits have different operation threshold voltages, and the first and second internal power supply potentials are out of phase to cancel out variations in first and second internal power supply potentials.

22. A device according to claim 19, wherein said first and second supply voltage-lowering circuits have different response speeds to generate a phase difference between the first and second internal power supply potentials to cancel out variations in first and second internal power supply potentials.

23. A semiconductor memory device comprising:

a semiconductor chip;

a plurality of memory cell arrays arranged in said semiconductor chip and divided into at least two subarrays in vertical and horizontal directions;

pads arranged between central memory cell arrays of the plurality of memory cell arrays;

a first supply voltage-lowering circuit arranged in said semiconductor chip to step down an external power supply potential of said semiconductor chip in response to a control signal, generate a first internal power supply potential, and supply the first internal power supply potential to the memory cell arrays; and a second supply voltage-lowering circuit arranged in said semiconductor chip to step down the external power supply potential of said semiconductor chip in response to the control signal, generate a second internal power supply potential of substantially the same level as that of the first internal power supply potential, and supply the second internal power supply potential to the memory cell arrays, said second supply voltage-lowering circuit canceling out variation in first internal power supply potential by variation in second internal power supply potential, wherein said first and second supply voltage-lowering circuits are respectively arranged near center pads to be adjacent to each other, pads near said first and second supply voltage-lowering circuits receive the external power supply potential and an external ground potential.

24. A device according to claim 23, wherein the first and second internal power supply potentials output from said first and second supply voltage-lowering circuits change out of phase with each other to cancel out variations in first and second internal power supply potentials.

25. A device according to claim 23, wherein said first and second supply voltage-lowering circuits have different operation threshold voltages, and the first and second internal power supply potentials are out of phase to cancel out variations in first and second internal power supply potentials.

26. A device according to claim 23, wherein said first and second supply voltage-lowering circuits have different response speeds to generate a phase difference between the first and second internal power supply potentials to cancel out variations in first and second internal power supply potentials.

* * * * *